US005613928A

United States Patent [19]

Laudone

[11] Patent Number: 5,613,928

[45] Date of Patent: Mar. 25, 1997

[54] JOINTED BAR FOR AN EXERCISE MACHINE

[76] Inventor: James A. Laudone, 13 Hunters Rd., Norwich, Conn. 06360

[21] Appl. No.: 459,472

[22] Filed: Jun. 2, 1995

Related U.S. Application Data

[63] Continuation-in-part of Ser. No. 287,401, Aug. 8, 1994, abandoned.

[51] Int. Cl.[6] ..... A63B 21/00

[52] U.S. Cl. ..... 482/139; 482/99; 482/100; 482/126; 482/129; 482/908

[58] Field of Search ..... 482/49, 98–100, 482/102, 103, 106, 121, 122, 126, 128, 129, 135–139, 907

[56] References Cited

U.S. PATENT DOCUMENTS

| | | | |
|---|---|---|---|
| 1,680,901 | 8/1928 | Meyer | 482/126 |
| 2,356,260 | 8/1944 | Maxwell | 482/129 |
| 2,529,347 | 11/1950 | Mohler et al. . | |
| 3,640,528 | 2/1972 | Proctor . | |
| 3,759,512 | 9/1973 | Yount et al. | 482/138 |
| 3,850,431 | 11/1974 | Winans . | |
| 4,441,706 | 4/1984 | Korzaniewski . | |
| 4,564,194 | 1/1986 | Dawson . | |
| 4,629,186 | 12/1986 | Aldridge | 482/126 |
| 4,720,096 | 1/1988 | Rogers | 482/126 |
| 4,744,559 | 5/1988 | Mahnke et al. . | |
| 4,861,022 | 8/1989 | Boatcallie | 482/126 |
| 4,900,015 | 2/1990 | Dissinger | 482/126 |
| 4,986,538 | 1/1991 | Ish, III . | |
| 5,058,888 | 10/1991 | Walker et al. | 482/139 |
| 5,080,349 | 1/1992 | Vittone | 482/139 |
| 5,184,992 | 2/1993 | Banks . | |
| 5,267,930 | 12/1993 | Henes . | |
| 5,273,506 | 12/1993 | Dawson, Jr. . | |
| 5,273,509 | 12/1993 | Vittone . | |

FOREIGN PATENT DOCUMENTS

| | | | |
|---|---|---|---|
| 1718711 | 3/1992 | U.S.S.R. | 482/126 |

OTHER PUBLICATIONS

"Swivel Grip" Flyer, Jun. 6, 1994.

*Primary Examiner*—Richard J. Apley
*Assistant Examiner*—Victor K. Hwang
*Attorney, Agent, or Firm*—Terrance L. Siemens

[57] ABSTRACT

An exercise bar for use with standard weight machines employing exercise bars. The bar is vertically hinged in the center, so that it is usable not only for pull down exercises, but also forms a vee which is compressed during pectoral exercises. The two sides of the vee are geared together, so that the vee opens and closes symmetrically, both arms being forced to move the same amount. An adjustable spring assembly attaches to the bar for selectively varying resistance for the pectoral exercises. A brace contacts the user's forearm, so that the user applies a force countering the tendency of the bar to incline responsive to being drawn downwardly. The bar is configured to include a relief in the center, so that it can be pulled down past the user's head, while avoiding interference with the user's neck. The novel exercise bar is rugged, uncomplicated, increases the number of exercises which can be performed, and can be retrofit to a standard weight machine.

13 Claims, 5 Drawing Sheets

JOINTED BAR FOR AN EXERCISE MACHINE

REFERENCE TO RELATED APPLICATION

This application is a Continuation-In-Part of Ser; No. 08/287,401, filed Aug. 8, 1994, now abandoned.

BACKGROUND OF THE INVENTION

1. Field of the Invention

The present invention relates to an exercise machine, and more particularly to a modular unit attachable to and usable with a preexisting weight training machine. The modular unit is adapted to enable certain compound motions generally not possible with standard weight and pulley exercise machines.

2. Description of the Prior Art

Exercising machines employing suspended weights for providing a resistance to body motions are well known in the prior art. These machines generally include a frame supporting weights attached to a tether. The tether is connected, in turn, to levers and similar components which are grasped by a user and manipulated. Manipulation against the resistance of the weights forces muscles to exert great effort, and thus will increase the strength or bulk of the muscles, or both, over time.

However, compound motions are seldom provided for in weight machines. Such motions are desirable since they can parallel natural body movement, and enable exercising muscles and groups of muscles that frequently cannot be properly exercised by simple motions. The reason why these motions tend to be ignored is that they frequently require great complexity of the machine. For example, a lever may require pivoting about plural axes. A compound motion may require substantial linear movement followed by a rotating movement. Any combination of these and other motions may be required, and may be further complicated by the requirement for gradual transition from one motion to the next.

U.S. Pat. No. 5,273,509, issued to Larry W. Vittone on Dec. 28, 1993, discloses a handle for a weight machine wherein right and left arms are each provided with an independently pivotable handle. Each handle is provided with a pivot comprising a ball joint located close to, but spaced apart from, the other ball joint. The two handles can pivot independently of one another. The motion so provided accommodates motion of each hand through a curved plane defined at a fixed radius from the center of the ball of the ball joint, and constrained by the maximum travel of the lever within the socket of the ball joint.

This device requires two joints, one for the handle for each hand. The nature of the device requires careful and precise fabrication, since the amount and constancy of frictional resistance of movement of the ball within the socket is subject to change over time and with wear. Extremely minute adjustments to the tightness of the socket components will greatly affect frictional resistance. It is therefore believed by the applicant that reliance upon ball joints renders the device most difficult to adjust with respect to intentionally varying this resistance. Also, wear and contamination may require frequent adjustment merely to maintain a constant degree of resistance.

A two armed exercising apparatus is shown in U.S. Pat. No. 2,529,347, issued to Stanley R. Mohler et al. on Nov. 7, 1950. The arms form a vee, and are hinged at the center of the vee. The arms are extended so that the overall configuration is generally that of an "H". A spring disposed upon the extensions of the arms resists spreading of the arms. This apparatus lacks gearing provided in the present invention for assuring that the arms spread and converge to the same degree.

It is frequent practice to attach a two grip handle to the cable of a weight machine. This attachment enables a user to hold the bar at a comfortable location or position. However, it does not enable a user to change the relative positions of his or her right and left hands relative to one another.

One example of this type of invention will be described in further detail, although the reader is cautioned to recognize the limited relevance to the instant invention. U.S. Pat. No. 5,267,930, issued to Richard W. Henes on Dec. 7, 1993, describes a weight machine wherein a handle is attached to a cable which can be pulled forwardly of the machine. The nature of the attachment enables the handle to pivot nearly universally with respect to the cable, and therefore to the machine. The handle comprises a single rod bent to enable right and left hand grips to project from the rod at an angle. This provides more comfortable grip. However, both handles are fixed on the rod, and no exercise can be performed wherein the user's arms approach one another.

The same feature regarding mounting of a solid exercise bar or the like is seen in U.S. Pat. Nos. 3,640,528, issued to Richard Proctor on Feb. 8, 1972; U.S. Pat. No. 3,850,431, issued to Louis A. Winans on Nov. 26, 1974; U.S. Pat. No. 4,441,706, issued to Mark M. Korzaniewski on Apr. 10, 1984; U.S. Pat. No. 4,564,194, issued to Fred Dawson on Jan. 14, 1986; U.S. Pat. No. 4,744,559, issued to Parker E. Mahnke et al. on May 17, 1988; U.S. Pat. No. 4,986,538, issued to Arthur B. Ish III on Jan. 22, 1991; U.S. Pat. No. 5,184,992, issued to Gary S. Banks on Feb. 9, 1993; and U.S. Pat. No. 5,273,506, issued to Frederic O. Dawson, Jr. on Dec. 28, 1993.

In these listed examples, a simple pulling exercise is enabled, and the user's arms and hands are constrained to relatively unvarying positions. There is no means for preventing unbalancing of the apparatus should the bar of one arm be moved more than the other, as may occur if one arm is stronger than the other, or if the user subconsciously exerts more force with one arm.

None of the above inventions and patents, taken either singly or in combination, is seen to describe the instant invention as claimed.

SUMMARY OF THE INVENTION

The present invention comprises an exercise bar for attachment to any standard weight machine for performing pull down exercises. A standard weight machine includes a frame supporting a cable attached to weights at one end. The cable is fed, as on pulleys, to a standard or conventional exercise bar. The novel exercise bar is attached to the remaining end of the cable, and is usable in place of the standard bar during exercises.

The novel exercise bar has separate, pivotable right and left handle members which are hinged together, thus enabling the user's arms to approach one another when desired, so that both pull down exercises and exercises promoting pectoral development may be practiced simultaneously. Of course, if desired, the bar may be pulled down and then compressed for pectoral development in a subsequent step. No adjustment to the bar is required in either case.

The exercise bar is hinged vertically in the middle, and forms a vee which is compressed during pectoral exercises so that the two handles substantially meet, the included angle being reduced to zero. The hinge is an uncomplicated yet rugged component which is not sensitive to wear, contamination, temperature, and other factors which could alter frictional characteristics of a ball and socket assembly.

The two sides of the vee are geared together, so that the handles are compressed to the same degree. If not geared or equivalently connected, it would be possible for a stronger arm to move its respective handle relatively quickly, thus disturbing symmetry of the apparatus, and possibly disrupting the exercise.

The novel exercise bar includes an adjustable spring for selectively varying resistive force provided during pectoral development exercises. The spring biases the exercise bar into the spread or extended position. This signifies that the included angle formed between the right and left handles is at its maximum value.

The adjustment device includes a nut which is threaded onto a threaded rod disposed coaxially with the spring. Preferably, a bearing or equivalent apparatus having mutually freely rotatable components is disposed between the nut and the spring. One race of the bearing is welded or otherwise fixed to the spring, and the other race is fixed to the nut. Thus, turning the nut to adjust spring tension does not wind up the spring.

The bar has a feature for preventing ineffectual inclination about the attachment point to the cable in response to being pulled down. A brace is provided for receiving force applied by the user's forearm. The user applies this force, which will be explained hereinafter, for countering a moment created by pulling the handles downwardly. Therefore, when in use, the bar remains at its original orientation with respect to the horizontal.

The bar is configured to include a relief so that the handles can be pulled below the level of the user's head, while interference of the bar with the user's neck is avoided.

Accordingly, it is a principal object of the invention to provide a bar usable with a weight machine having a cable attached to weights for enabling pull down or latissimus dorsi muscle exercises.

It is another object of the invention to provide a bar which can also be employed for pectoral development exercises without adjustment or modification to the bar when employed for pull down exercises.

Still another object of the invention is to bias the right and left handles of the exercise bar into the spread or extended position.

A further object of the invention is to cause the right and left handles to open and close to the same degree.

It is an additional object of the invention to provide a rugged and uncomplicated form of joint.

It is again an object of the invention to selectively vary the force opening or spreading the right and left handles apart.

Yet another object of the invention is to avoid winding up a spring spreading the right and left handles apart.

Another object of the invention is to avoid interference of the exercise bar with the user's neck when engaged in pull down exercises.

A still further object of the invention is to counter a moment created by pulling the bar downwardly, so that the bar remains in an original orientation with respect to the horizontal.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
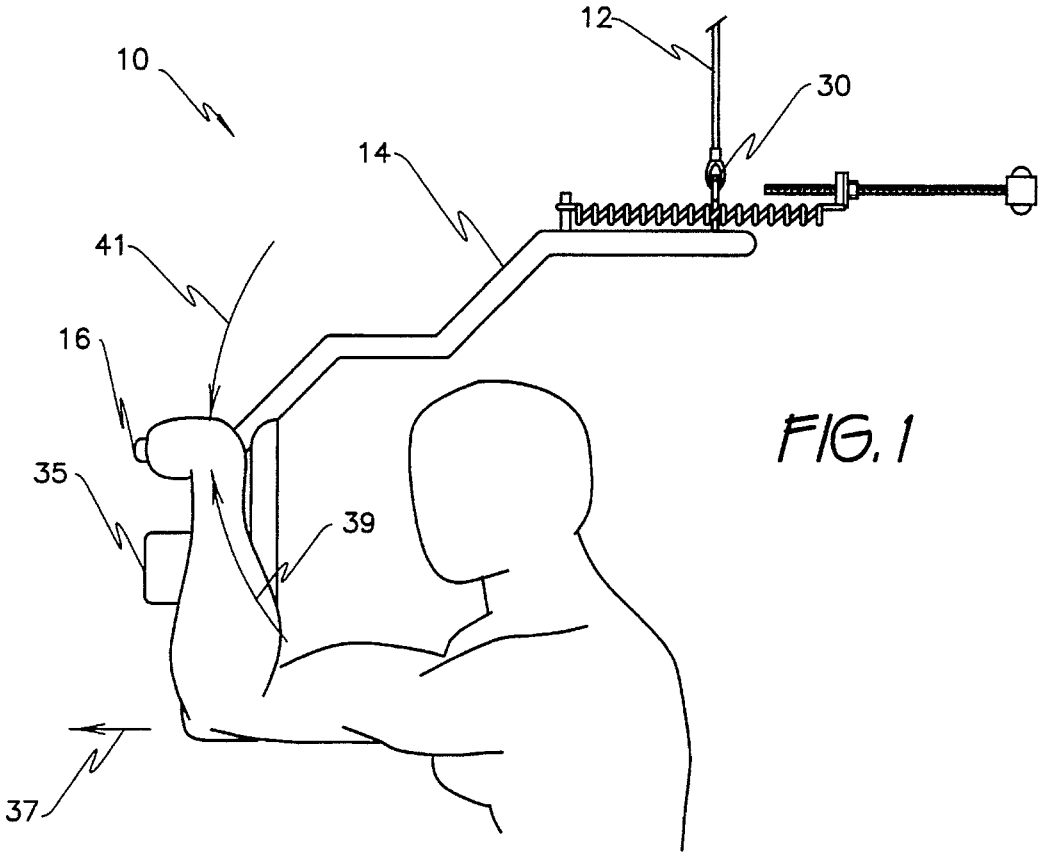
FIG. 1 is an environmental, side elevational view of the invention.

As seen in FIG. 1, the novel exercise bar 10 is attached to the weighted cable 12 of any standard weight machine (not shown in its entirety). Although weight machines vary in configuration, they share the characteristic that they pay out cable 12, which is attached to weights (not shown). It will be appreciated that an exercise bar is readily replaced by one of different configuration without changing the essential performance and method of use of the weight machine. Therefore, the weight machine will not be discussed in further detail.

Exercise bar 10 has a left handle 14 and a right handle (see FIG. 3), each having a respective hand grip 16. Exercise bar 10 is grasped in conventional fashion by the user, and the precise method of use will be discussed hereinafter.

Figure 2:
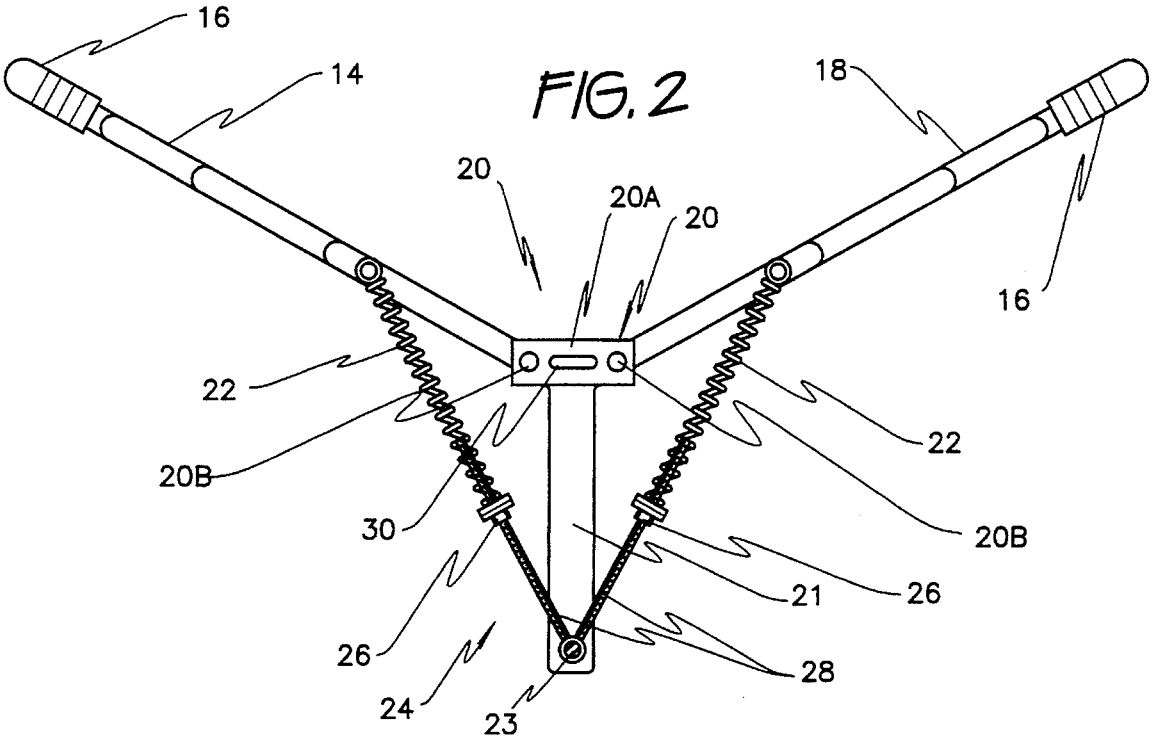
FIG. 2 is a top plan, detail view of the invention, showing the hinging and the spring biasing the right and left members of the bar into the fully spread or open position.

Referring now to FIG. 2, left and right handles 14,18 are seen to be of equal length, and pivot about vertical hinges 20. It must be stressed that hinges 20 encompass any arrangement enabling handle members 14,18 to pivot on exercise bar 10. This may be accomplished by providing individual pivot pins 20B and two hinges 20, as depicted in this Figure. Alternatively, a hinge may incorporate a common pivot pin serving both handle members 14,18 simultaneously. This alternative embodiment of a hinge is not illustrated, but is described to clarify that an effective hinging arrangement serving both handle members 14,18 is present. Separate hinges 20 are representative of any suitable hinging arrangement.

Handle members 14 and 18 are solid and rigid, and are pivotally connected at hinges 20. Hinges 20 may comprise friction pins, rivets, bolts and nuts, or any other suitable members enabling pivot of handle members 14,18 thereabout.

The hinging arrangement may incorporate two separate hinges 20, as illustrated. This will provide for symmetrical loading on the central, stationary member 20A connected to weighted cable 12, which is further described hereinafter.

A compression coil spring 22 is mounted coaxially about each one of two arms 24 bearing against handle members 14,18, and biasing members 14,18 into the spread or extended condition. A nut 26 is tightened on threads 28 formed in each arm 24. Tightening and slackening nuts 26 adjusts pressure spreading or extending exercise bar 10.

In an alternative hinging arrangement, stationary member 20A could be eliminated, handle members 14,18 extending to a common pivot (not shown). If member 20A were eliminated, then a solid member 21, perpendicular to member 20A as depicted, would remain, connecting the common pivot of handle members 14,18 to the common pivot 23 of arms 24.

Figure 3:
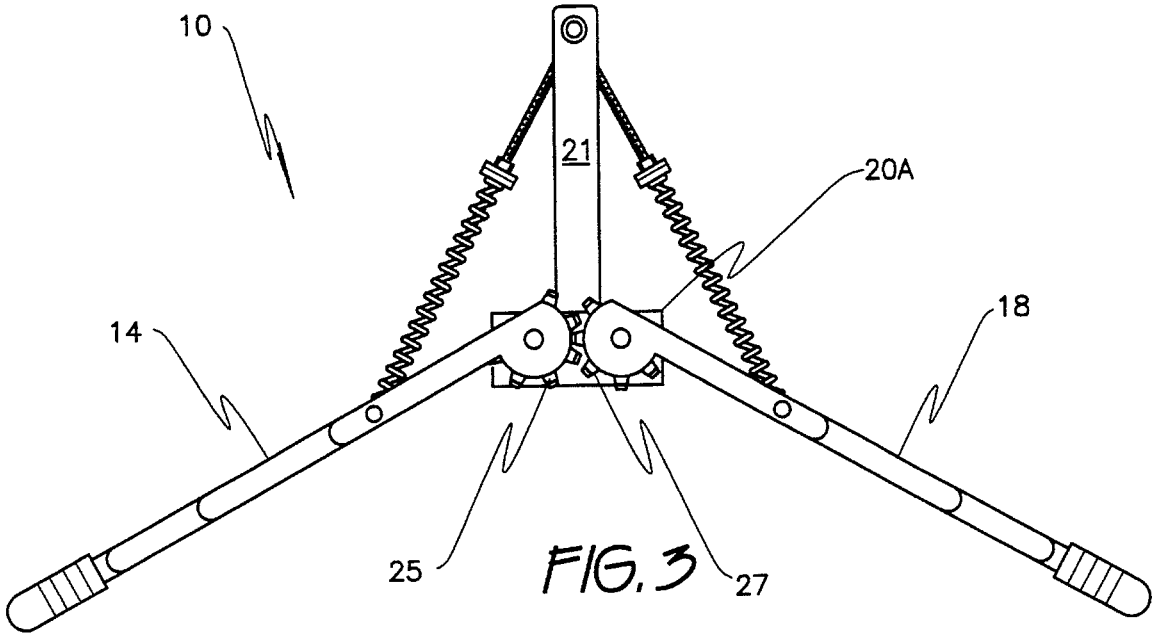
FIG. 3 is a bottom plan view of the invention.

Handle members 14,18 are constrained to pivot, thus opening and closing the vee they collectively describe, to the same degree. Referring now to FIG. 3, intermeshing gears 25,27 are each fixed to a respective handle member 14 or 18. Movement of each handle member 14 or 18 must perforce move its counterpart to the same degree.

Figure 4:
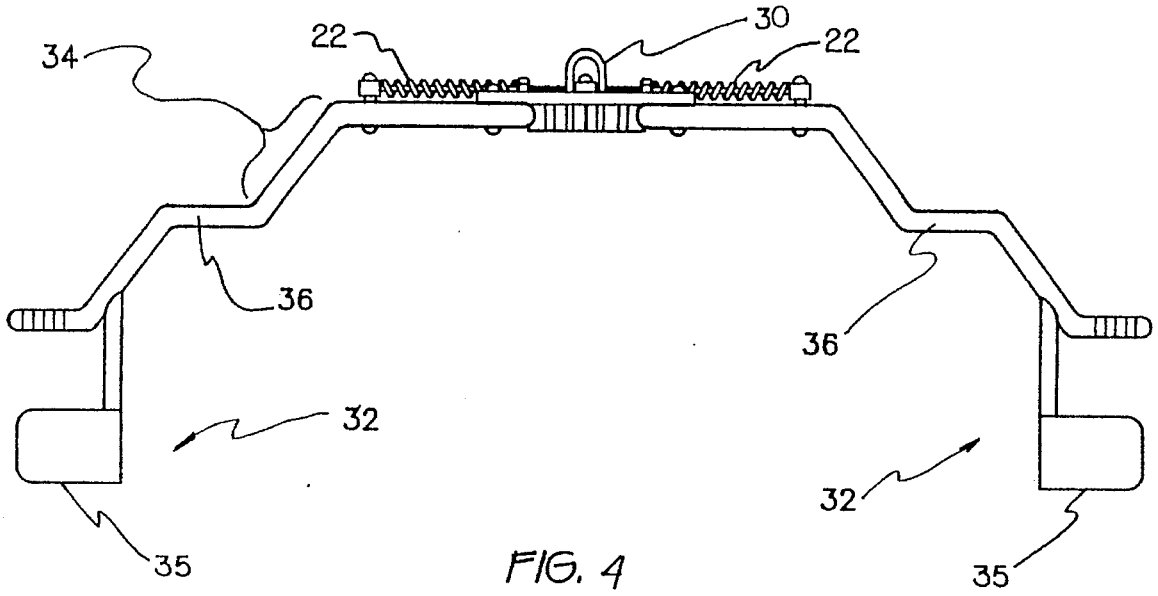
FIG. 4 is a front elevational view of the invention.

FIG. 4 illustrates an eye 30 for engaging weighted cable 12 (see FIG. 1). Cable 12 is attached to eye 30 in any suitable fashion. Also visible in this view are forearm rests 32 secured to each handle member 14 or 18, as well as an offset portion 34 located at the middle of exercise bar 10, below and extending slightly outside springs 22.

Each handle member 14 or 18 has two bends, and offset portion 34 is defined by the combination of the two handle members 14,18. Offset section 34 is that portion of handle members 14 and 18 shown projecting above straight, horizontal sections 36 in this Figure. Section 34 is offset upwardly with respect to hand grips 16 of handle members 14,18.

Offset portion 34 accommodates protrusion of the user's neck when exercise bar 10 is pulled down to the extent that straight sections 36 of handle members 14,18 are below the level of the user's head. This position of sections 36 corresponds to a level achieved when exercise bar 10 is drawn downwardly maximally during ordinary lattisumus dorsi muscle pull down exercises. Obstruction of the exercise, or interference between said exercise bar and the neck of the user, is thus avoided.

Figure 5:
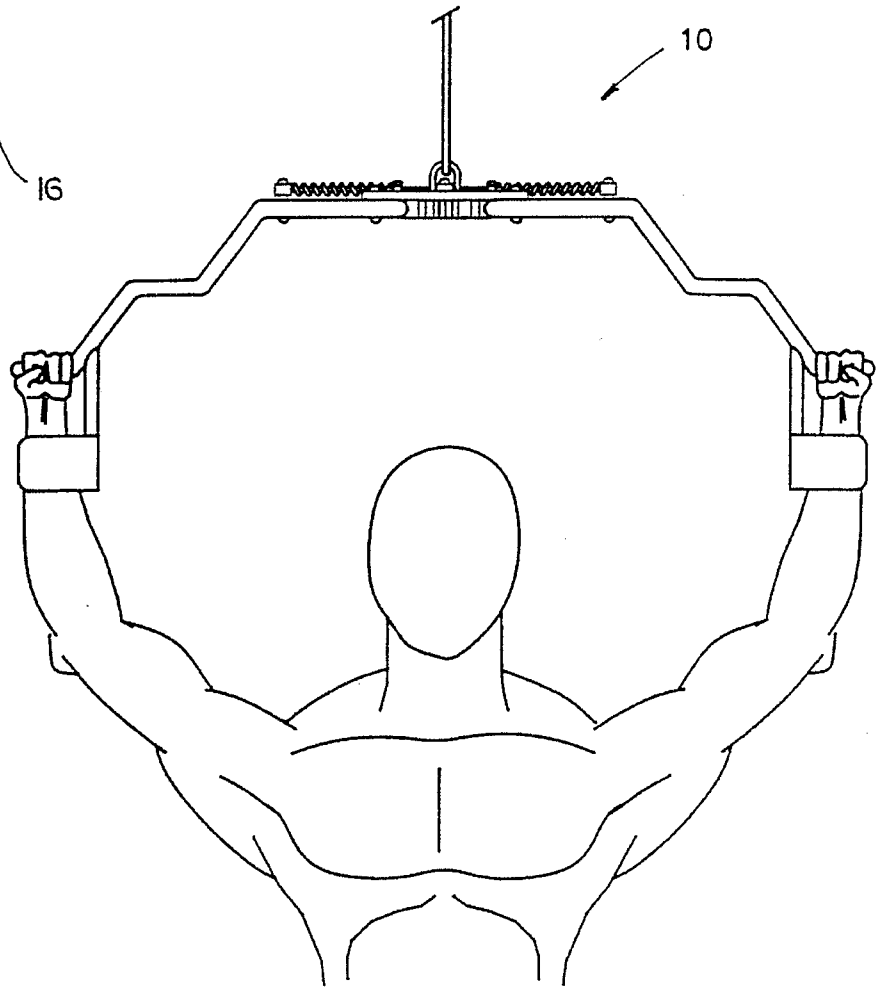
FIG. 5 is an environmental, front elevational view of the invention illustrating the first principal position of the user when using the invention.
Figure 6:
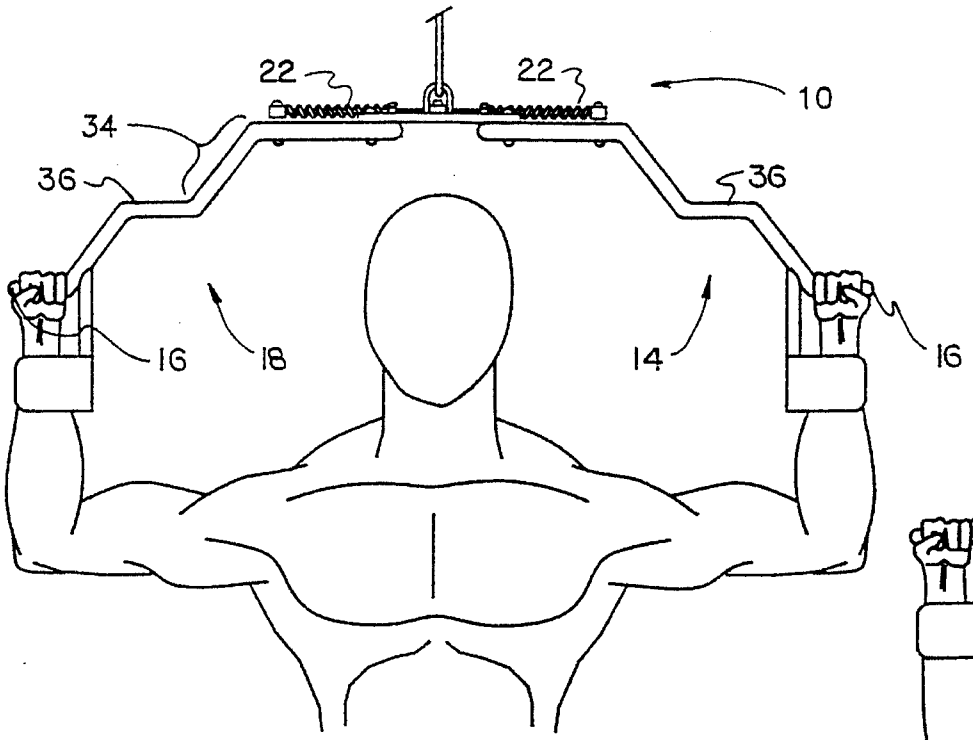
FIG. 6 is an environmental, front elevational view of the invention illustrating the second principal position of the user when using the invention.

The novel exercise bar 10 can be employed to perform standard pull down exercises, as shown in FIGS. 5 and 6. FIG. 5 shows an initial position assumed by a user when performing a pull down. FIG. 6 shows exercise bar 10 pulled down maximally, offset section 34 enabling exercise bar 10 to clear the user's neck.

It would be expected that in response to being pulled downwardly, bar 10 would develop a moment which would merely cause it to incline downwardly. This moment, which exists about the point of attachment of cable 12 to eye 30, is countered by the user in the following manner. As best seen in FIG. 1, the user places his forearm against a brace 35. The user then attempts to thrust his upper arm forward, as indicated by arrow 37. This is performed simultaneously with the motions of the pull down exercise.

With his feet on the floor, and employing his own weight, the user moderates the force represented by 37, no actual forward motion actually being caused. Instead, the user creates a moment indicated by 39 which counters the moment created by pulling downwardly on handle grips 16. The latter moment is indicated by arrow 41. Braces 35 are also shown isolated from the user for clarity in FIG. 3.

Figure 7:
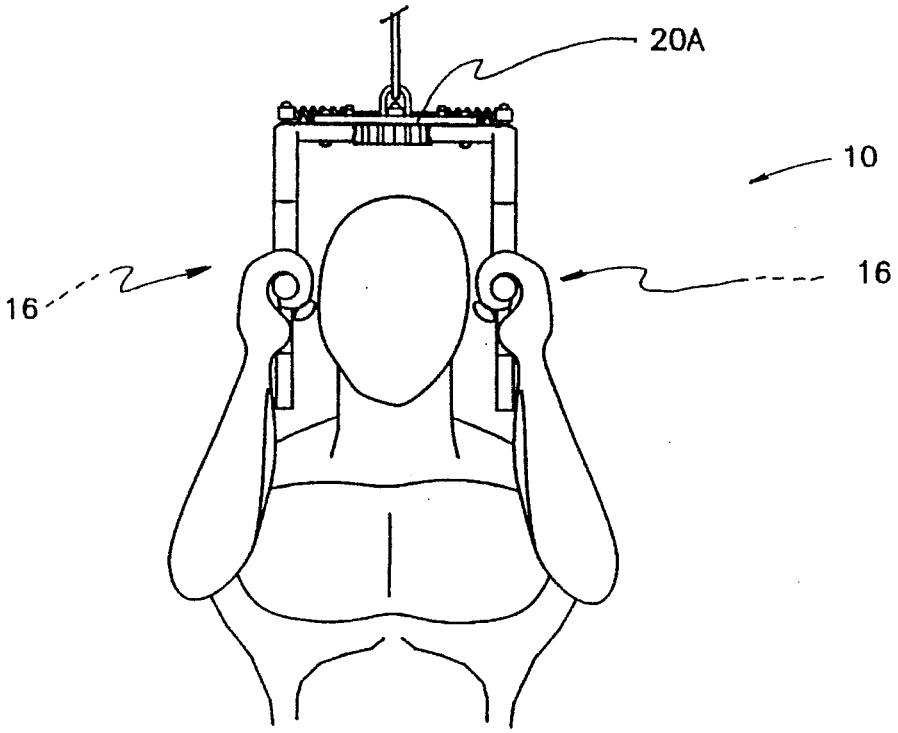
FIG. 7 is an environmental, front elevational view of the invention illustrating the third principal position of the user when using the invention.

A second type of exercise which can be performed with novel exercise bar 10 is illustrated in FIG. 7. Compressing the vee formed by exercise bar 10 develops pectoral muscles. Handle members pivot about hinge 20, moving in a horizontal plane, with hand grips 16 eventually meeting one another. This exercise may be performed after completion of a pull down exercise, or the two exercises may be performed simultaneously. Exercise bar 10 accommodates both exercises whether performed subsequently or simultaneously without adjustment or modification.

Figure 8:
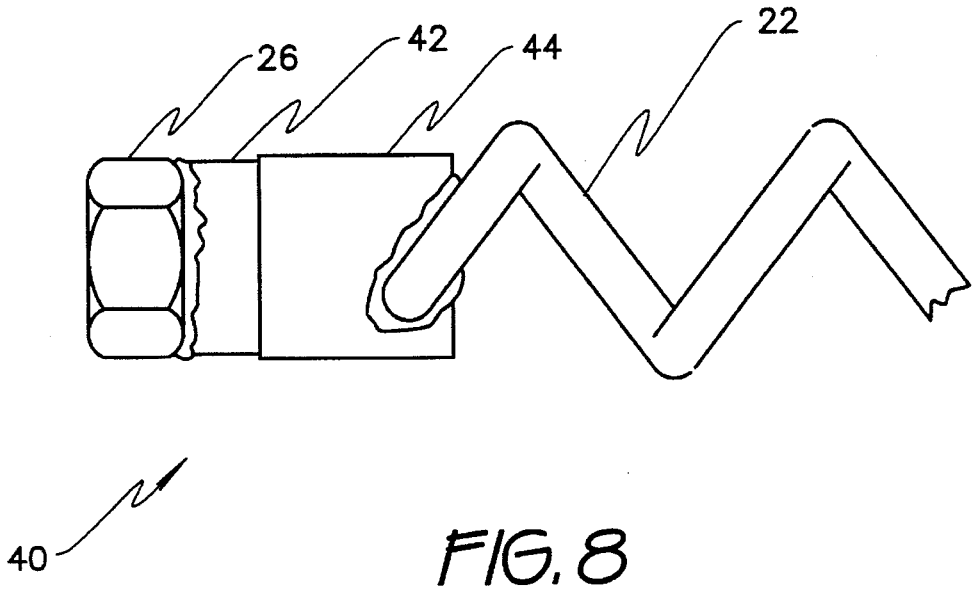
FIG. 8 is a side elevational detail view of attachment of a spring to its adjustment nut.

It is preferred that in the the embodiment of FIG. 1, each spring 22 be prevented from winding up when its associated nut 26 is tightened. An arrangement to accomplish this function is shown in FIG. 8. A bearing 40 surrounds rod 28. Bearing 40 has an inner race 42 and an outer race 44. Nut 26 is welded to inner race 42, and spring 22 is welded to outer race 44. Now, nut 26 can turn freely without binding against and winding spring 22.

It will occur to those of skill in the art that certain modifications can be made to the novel exercise bar 10. For example, additional gears (not shown) may be interposed between gears 25 and 27. In another example, and in reference to the arrangement for preventing winding of spring 22, spring 22 may be fixed to inner race 42, with nut 26 fixed to outer race 44.

Figure 9:
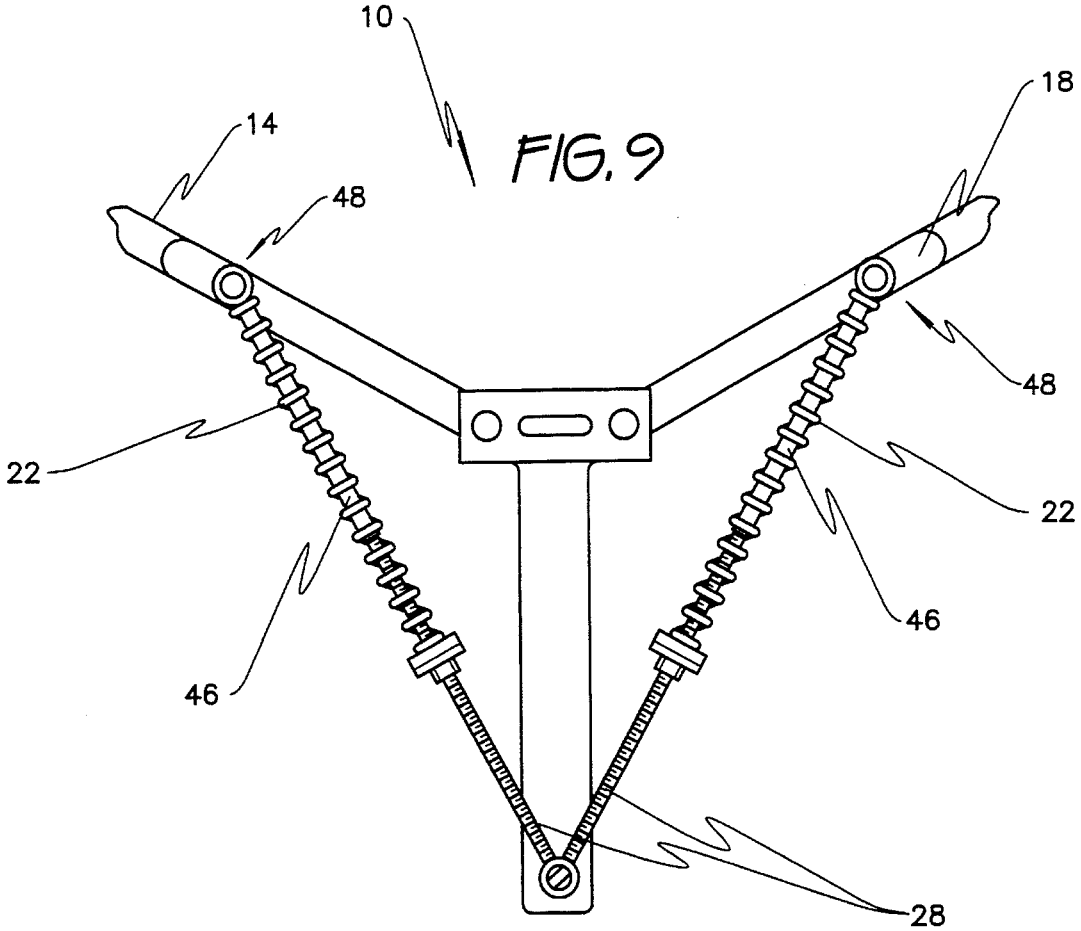
FIG. 9 is a top plan view of an alternative embodiment of the invention wherein a spring urging the vee into the open or spread position surrounds a telescoping member maintaining the spring in its operative position.

If desired, and as shown in FIG. 9, arms 24 may be provided with respective telescoping extensions 46 anchored to pivot points 48 on handle members 14 and 18. Arms 24 act as guides constraining springs 22 to be operably oriented. If springs 22 are made from thick rod stock, they will not misalign. If narrow gauge rod stock is employed, or if springs 22 are flexible for another reason, springs 22 could possibly misalign, assume a non-linear configuration, or even pull free of arms 24. The telescoping arrangement of FIG. 9 will assure appropriate straight, operable configuration of springs 22.

Figure 10:
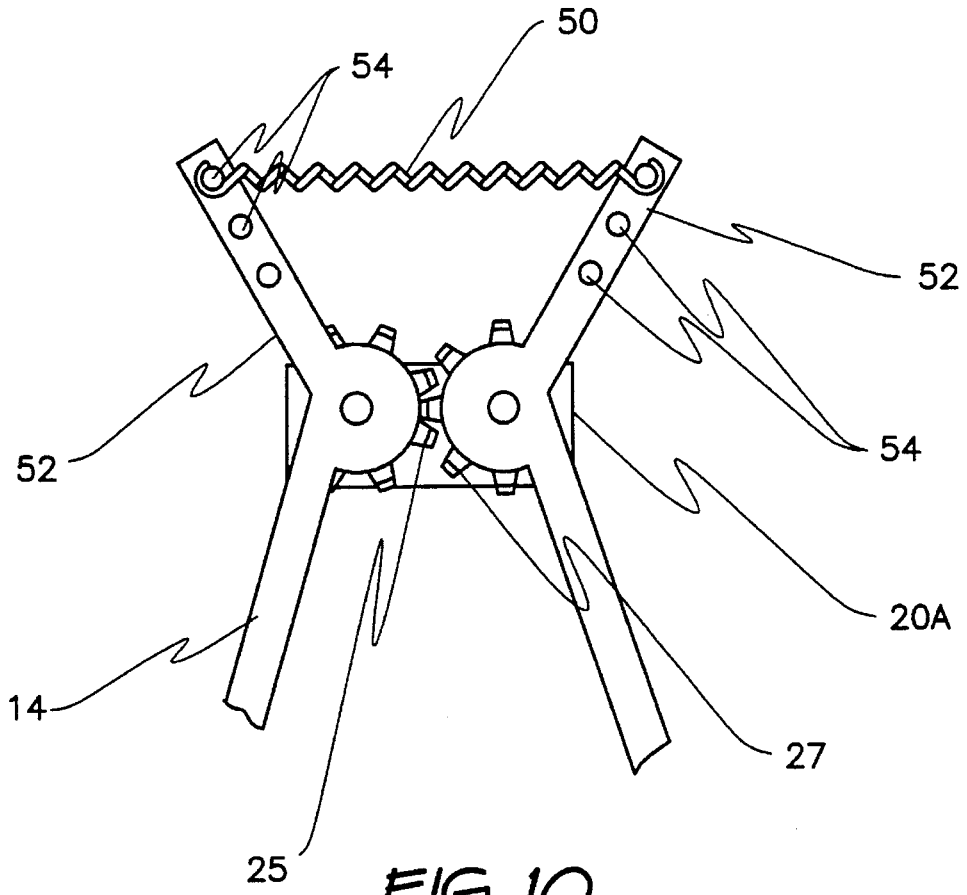
FIG. 10 is a top plan view of an alternative arrangement of the invention wherein the handles have extensions, and only one spring for spreading the handles apart is provided.

In a further alternative embodiment, as seen in FIG. 10, it would be possible to configure the novel exercise bar 10 in the approximate form of an H, in the manner shown in U.S. Pat. No. 2,529,347, to Mohler et al. In this embodiment, there is a single spring 50 located between extensions 52 of handle members 14 and 18. In this embodiment, spring 50 is a tension spring, and the spring adjustment arrangement of FIG. 1 is not employed. Adjustment of tension may be provided by anchoring spring 50 selectively within holes 54 located periodically along extensions 52.

Obviously, still other modifications may be introduced while not departing from the inventive concept. It is to be understood that the present invention is not limited to the embodiments described above, but encompasses any and all embodiments within the scope of the following claims.

I claim:

1. An exercise bar for attachment to an exercise machine having a weighted cable, said exercise bar engagable with the weighted cable, and comprising;

a right handle member and a left handle member;

intermeshing gears mounted on said exercise bar, including a first gear fixed to said right handle member and a second gear fixed to said left handle member;

hinge means, including at least one hinge, said hinge means pivotally connecting said right handle member and said left handle member to said exercise bar, said gears constraining said right handle member and said left handle member to pivot to the same degree; and an eye connected to said exercise bar for engaging the weighted cable.

2. The exercise bar according to claim 1, said hinge means having a vertical axis of pivot for each said hinge, whereby said right handle member and said left handle member move in a horizontal plane when compressed during pectoral exercises.

3. The exercise bar according to claim 1, said right handle member and said left handle member each including a central raised horizontal section and a hand grip disposed below said central raised horizontal section, said hinge means being pivotally connected at each said horizontal central raised section, whereby interference is avoided between said exercise bar and the head of a user when drawing said exercise bar down past the head.

4. The exercise bar according to claim 1, further including spring means for biasing said handle members into a diametrically opposed spread position with respect to said hinge means.

5. The exercise bar according to claim 4, further including means for adjusting said spring means to vary pressure biasing said handle members into said diametrically opposed spread position.

6. The exercise bar according to claim 5, wherein said spring means includes a coil spring, and said means for adjusting said spring means comprises a nut threaded onto a threaded rod disposed coaxially with said coil spring.

7. The exercise bar according to claim 6, further comprising apparatus having two mutually rotatable members, said nut attached to one of said two mutually rotatable members, and said coil spring attached to the other of said two mutually rotatable members, whereby adjusting said nut on said threaded rod avoids winding said coil spring.

8. The exercise bar according to claim 1, said right handle member and said left handle member each including a respective brace adapted to contact the user's forearm when in use, whereby the user applies a force countering a moment created when by pulling said exercise bar downwardly, and thus maintaining said exercise bar in an original orientation with respect to the horizontal.

9. An exercise bar for attachment to an exercise machine having a weighted cable, said exercise bar engagable with the weighted cable, and comprising;

a right handle member and a left handle member;

hinge means pivotally connecting said right handle member and said left handle member to said exercise bar, said hinge means having a vertical axis of pivot, whereby said right handle member and said left handle member move in a horizontal plane when compressed during pectoral exercises;

spring means having a coil spring for biasing said handle members into a diametrically opposed spread position with respect to said hinge mean;

a threaded rod disposed coaxially with said coil spring, and a nut threaded onto said threaded rod and engaged with said coil spring for adjusting said coil spring.

10. The exercise bar according to claim 9, further comprising an eye attached to said exercise bar, for engaging the weighted cable.

11. The exercise bar according to claim 9, said right handle member and said left handle member each including a central raised horizontal section and a hand grip disposed below said central raised horizontal section, said hinge means being pivotally connected at each said horizontal central raised section, whereby interference is avoided between said exercise bar and the head of a user when drawing said exercise bar down past the head.

12. The exercise bar according to claim 9, further comprising apparatus having two mutually rotatable members, said nut attached to one of said two mutually rotatable members, and said coil spring attached to the other of said two mutually rotatable members, whereby adjusting said nut on said threaded rod avoids winding said Coil spring.

13. The exercise bar according to claim 9, said right handle member and said left handle member each including a respective brace adapted to contact the user's forearm when in use, whereby the user applies a force countering a moment created when by pulling said exercise bar downwardly, and thus maintaining said exercise bar in an original orientation with respect to the horizontal.

* * * * *